US010337158B2

(12) United States Patent
Carrier

(10) Patent No.: US 10,337,158 B2
(45) Date of Patent: Jul. 2, 2019

(54) SNOW ROLLER ACCESSORY FOR USE ON SNOW BLOWER DEVICES

(71) Applicant: François Carrier, Quebec (CA)

(72) Inventor: François Carrier, Quebec (CA)

( * ) Notice: Subject to any disclaimer, the term of this patent is extended or adjusted under 35 U.S.C. 154(b) by 21 days.

(21) Appl. No.: 15/586,615

(22) Filed: May 4, 2017

(65) Prior Publication Data

US 2017/0321386 A1 Nov. 9, 2017

Related U.S. Application Data

(60) Provisional application No. 62/391,600, filed on May 5, 2016.

(51) Int. Cl.

| | |
|---|---|
| ***E01H 4/00*** | (2006.01) |
| ***E01H 5/09*** | (2006.01) |
| ***E02F 9/22*** | (2006.01) |

(52) U.S. Cl.

CPC ..... *E01H 4/00* (2013.01); *E01H 5/098* (2013.01); *E02F 9/2271* (2013.01)

(58) Field of Classification Search

CPC ..... E01H 4/00–02; E01H 5/00–098

See application file for complete search history.

(56) References Cited

U.S. PATENT DOCUMENTS

| | | | | |
|---|---|---|---|---|
| 3,794,122 | A * | 2/1974 | Rohrer | E01H 4/02 172/120 |
| 4,021,942 | A * | 5/1977 | Purdy | E01H 4/02 172/145 |
| 4,056,328 | A * | 11/1977 | Maxey | E01H 4/00 172/787 |
| 4,193,710 | A * | 3/1980 | Pietrowski | E01C 19/266 172/518 |
| 4,224,751 | A * | 9/1980 | Schoemann | E01H 5/02 294/59 |
| 4,359,831 | A * | 11/1982 | Beeley | E01H 5/098 172/112 |
| 7,997,826 | B2 * | 8/2011 | Dufty | A01B 29/02 404/132 |
| 8,668,405 | B1 * | 3/2014 | Singleton | E01C 23/06 404/122 |
| 9,206,568 | B2 | 12/2015 | Distefanis | |
| 2009/0238644 | A1 * | 9/2009 | Dufty | A01B 29/02 404/122 |

* cited by examiner

*Primary Examiner* — Matthew Troutman

(57) ABSTRACT

A snow roller accessory for use on a snow blower device installed on a mechanical vehicle comprising a support frame having a first end and a second end; a first bracket coupled to the first end, and a second bracket coupled to the second end; a first ball bearing member attached to the first bracket, and a second ball bearing member attached to the second bracket; a cylinder rotationally connected to the first and second ball bearing members; and at least one hydraulic piston having a upper end and a lower end, wherein the at least one hydraulic piston is configured to adjust the snow roller accessory in relation to a ground level.

2 Claims, 4 Drawing Sheets

SNOW ROLLER ACCESSORY FOR USE ON SNOW BLOWER DEVICES

CROSS-REFERENCE TO RELATED APPLICATIONS

The present application claims priority to U.S. Provisional Patent Ser. No. 62/391,600, filed on May 5, 2016 entitled "Snow roller accessory for use on snow blower devices", the disclosure of which is hereby incorporated in its entirety at least by reference.

BACKGROUND OF THE INVENTION

1. Field of the Invention

The present invention relates generally to snow-plow and snow-blowing machinery, but more particularly a snow roller accessory for use on snow blower devices.

2. Description of Related Art

Every winter, in areas affected by snow storms, snow-blowers are used for the removal of snow on roads, city streets, parking lots, and any other places where it is not desired. When a snow blower is used over a surface that consists of pebbles, gravel or such aggregate material, the removal operation picks up some of the aggregates and blows them over with the snow on the front yards and lawns of homes. When spring comes, and the melting snow exposes the lawn, the aggregates can be seen mixed with the grass. Snow removal employees need to remove that unwanted material in order to keep the client satisfied. Since this operation is not the client's fault, the costs for unwanted material defers to the contractor, which results in the contractor charging more for the snow removal contract in order to compensate for that extra expense. Consequently, there is a need for resolving this aggravating problem which is costly and time consuming for the contractor and forces higher prices for the clients.

BRIEF SUMMARY OF THE INVENTION

In one embodiment of the present invention a snow roller accessory for use on a snow blower device installed on a mechanical vehicle is provided, the snow roller accessory comprising a support frame having a first end and a second end; a first bracket coupled to the first end, and a second bracket coupled to the second end; a first ball bearing member attached to the first bracket, and a second ball bearing member attached to the second bracket; a cylinder rotationally connected to the first and second ball bearing members; at least one hydraulic piston having an upper end and a lower end, wherein the at least one hydraulic piston is configured to adjust the snow roller accessory in relation to a ground level; at least one attachment bracket attached to the upper end of the at least one hydraulic piston and the at least one attachment bracket is attached to an existing interface member provided on the mechanical vehicle, wherein the existing interface member connects the snow roller accessory to the snow blower device; at least one hinge bracket extending upwardly from the support frame; and a connector extension extending integrally from the at least one hinge bracket, wherein the lower end of the at least one hydraulic piston is attached to the connector extension.

In one embodiment, the cylinder is constructed from steel. In another embodiment, the cylinder includes a surface material cover consisting of rubber, wherein the surface material cover is configured to limit the tendency for the snow to stick to the cylinder and to prevent the steel from rust. In one embodiment, the cylinder is 6 inches in diameter, 80 inches in length, and weighing 150 pounds. In another embodiment, the at least one hydraulic piston is provided power from an existing hydraulic system on the mechanical vehicle. In yet another embodiment, the existing interface member is connected to a three point hitch provided on the mechanical vehicle, and the at least one hinge bracket rotationally to the three point hitch such that a protraction or a retraction of the at least one hydraulic piston adjusts the height of the in relation to the ground level. In one embodiment, the at least one hydraulic piston is two hydraulic pistons, the at least one attachment bracket is two attachment brackets, and the at least one hinge bracket is two hinge brackets.

In another aspect of the invention, a snow roller accessory for use on a snow blower device installed on a mechanical vehicle, the snow roller accessory comprising a support frame having a first end and a second end; a first bracket coupled to the first end, and a second bracket coupled to the second end; a first ball bearing member attached to the first bracket, and a second ball bearing member attached to the second bracket; a cylinder rotationally connected to the first and second ball bearing members; and at least one hydraulic piston configured to adjust the snow roller accessory in relation to a ground level.

BRIEF DESCRIPTION OF THE SEVERAL VIEWS OF THE DRAWINGS

Other features and advantages of the present invention will become apparent when the following detailed description is read in conjunction with the accompanying drawings, in which.

DETAILED DESCRIPTION OF THE PREFERRED EMBODIMENT

Figures 1A, 1B:
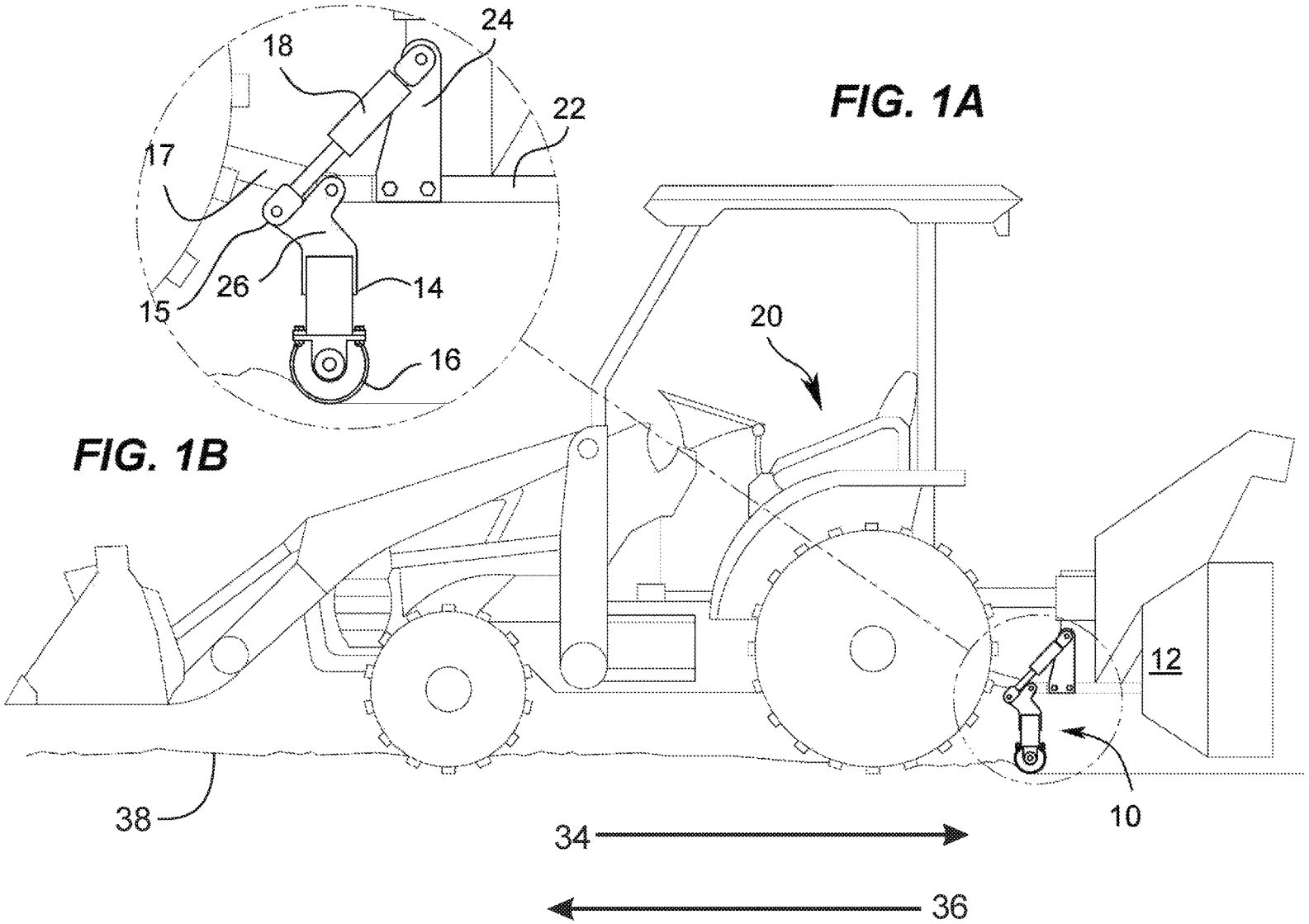
FIG. 1A is a side perspective view of a snow roller accessory for use on a snow blower device installed on a mechanical vehicle according to an embodiment of the present invention.
FIG. 1B is a detailed view of a FIG. 1A.
Figure 2:
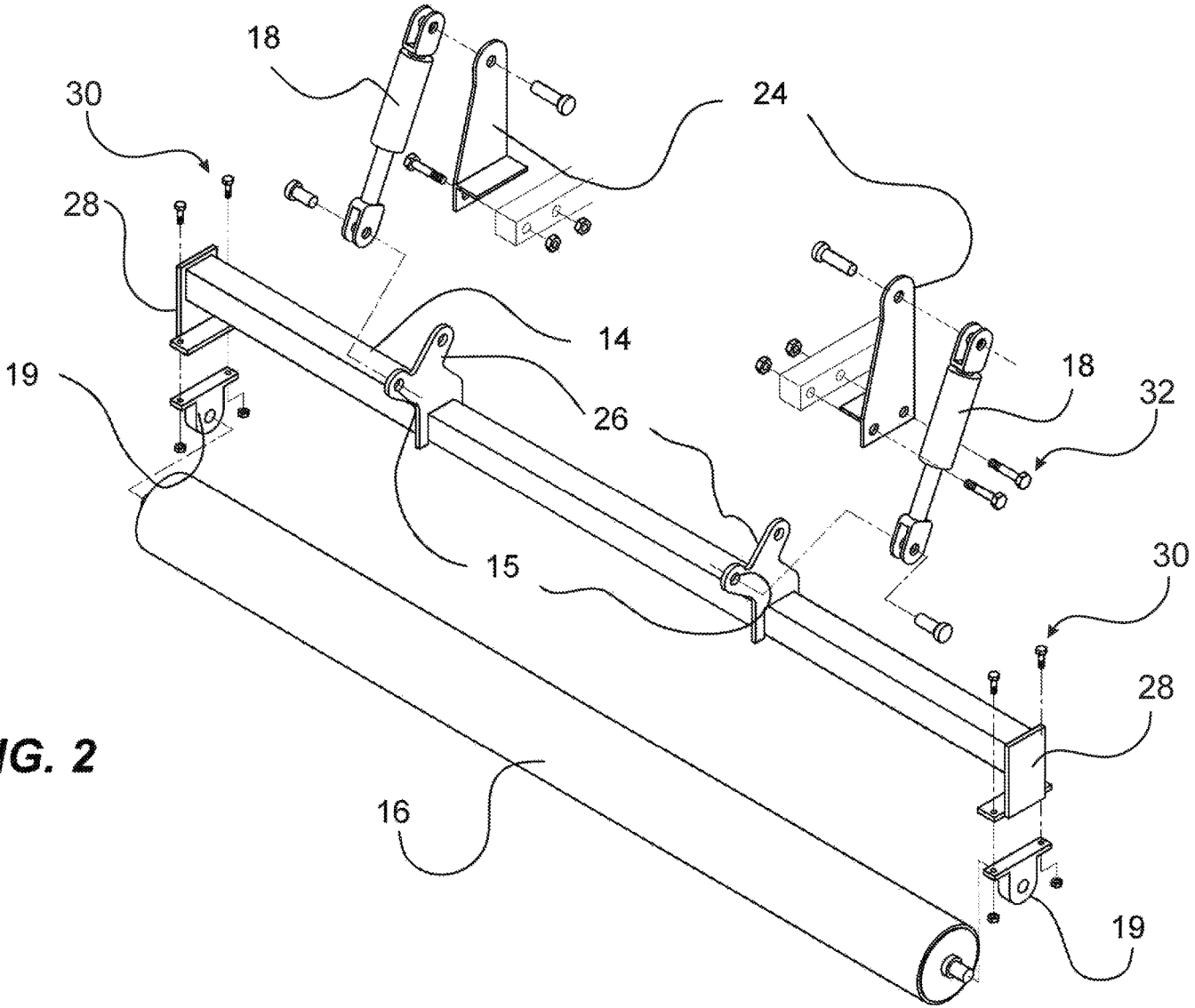
FIG. 2 is an exploded view of a snow roller accessory for use on a snow blower device according to an embodiment of the present invention.
Figure 3:
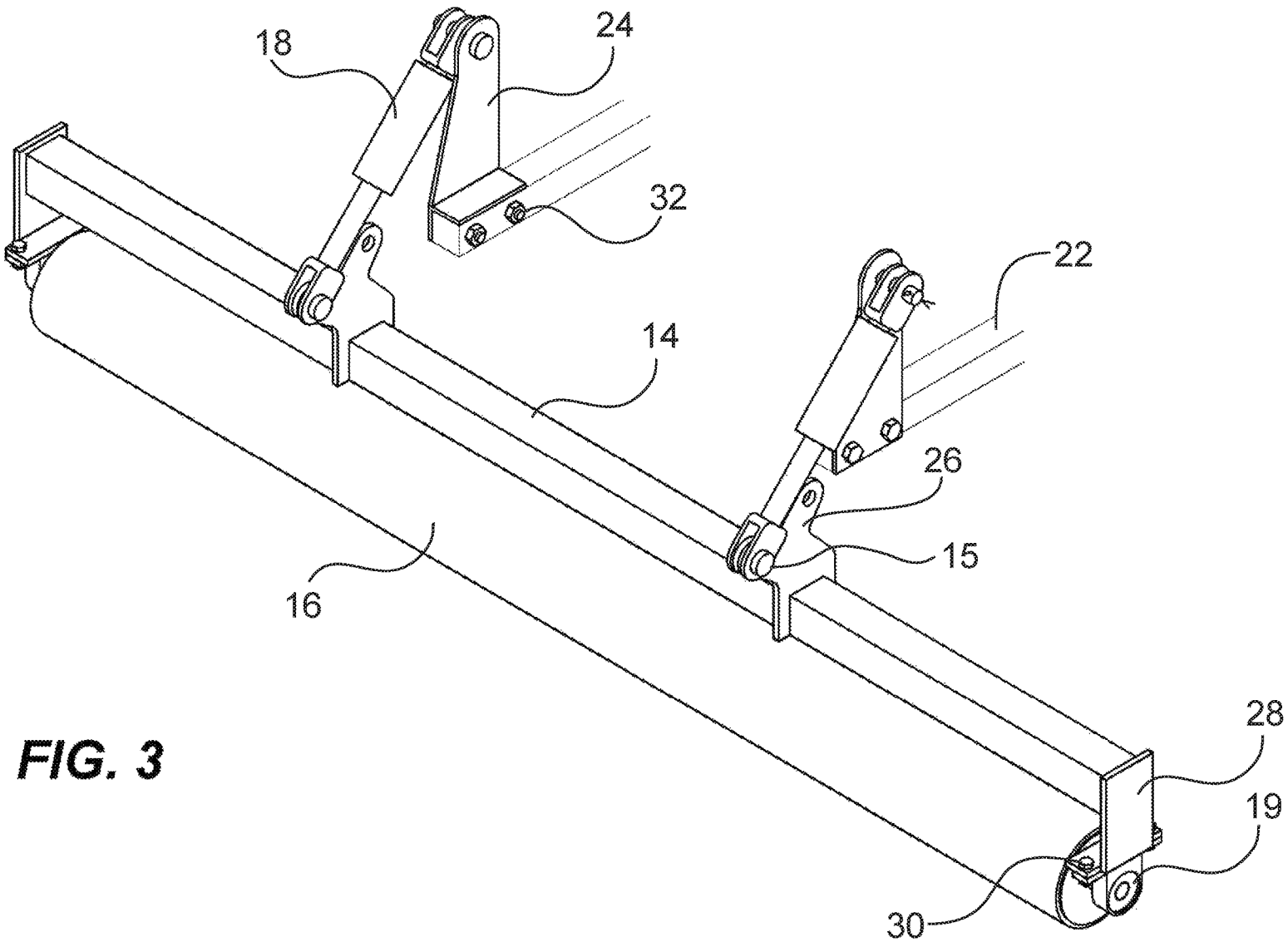
FIG. 3 is an isometric view of a snow roller accessory for use on a snow blower device according to an embodiment of the present invention.
Figure 4A:
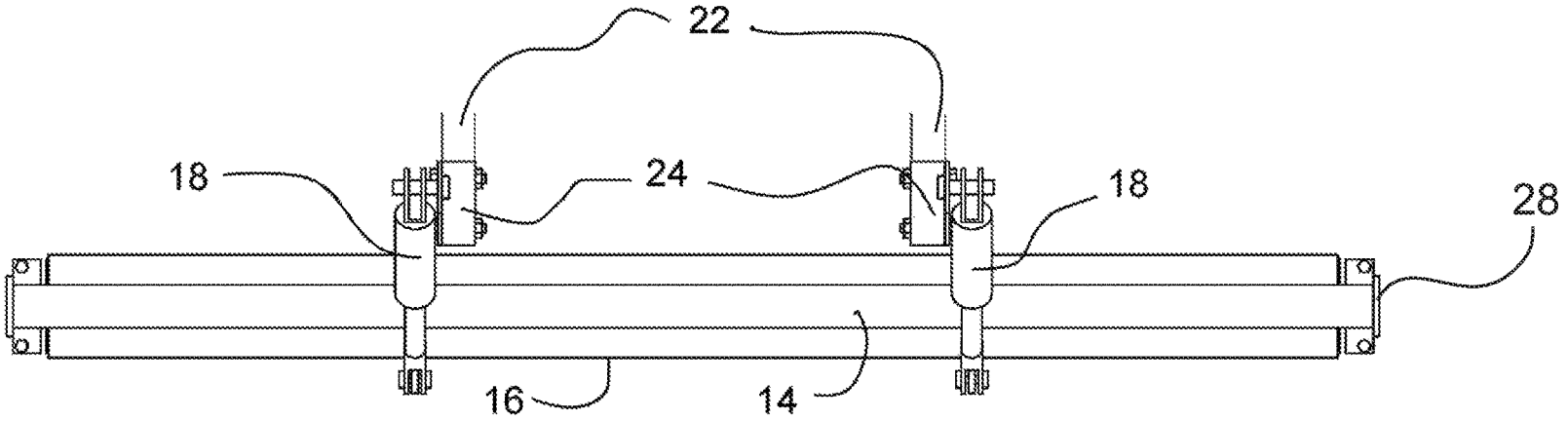
FIGS. 4A-B are top and front perspective views of a snow roller accessory for use on a snow blower device installed on a mechanical vehicle according to an embodiment of the present invention.
Figure 4B:
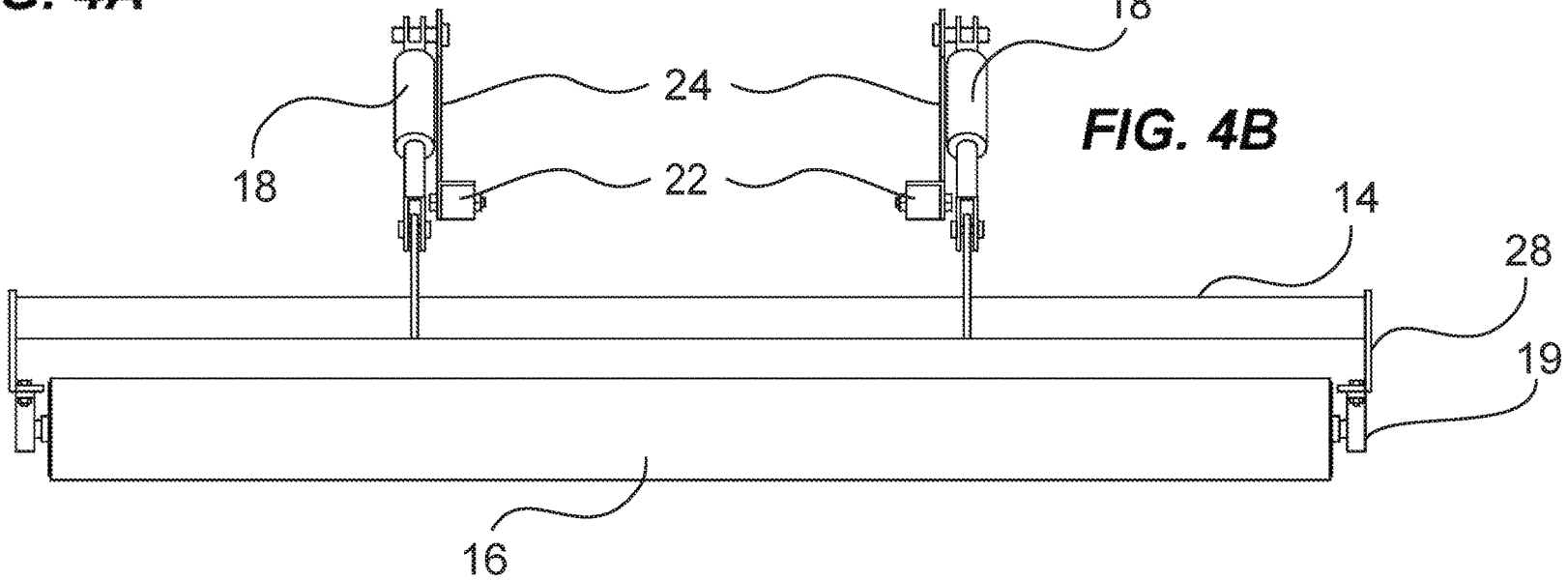

The following description is provided to enable any person skilled in the art to make and use the invention and sets forth the best modes contemplated by the inventor of carrying out their invention. Various modifications, however, will remain readily apparent to those skilled in the art, since the general principles of the present invention have been defined herein to specifically provide a snow roller accessory for use on snow blower devices.

FIGS. 1-4 illustrate a snow roller accessory 10 for use on a snow blower device 12 installed on a mechanical vehicle 20 according to an embodiment of the present invention. Now referring to FIGS. 1-4, the snow roller accessory comprises a support frame 14 and a cylinder 16. In one embodiment, brackets 28 are coupled to each end of the support frame, by any suitable means known in the art. In one embodiment, ball bearing members 19 are attached to the brackets via mounting hardware 30. The mounting hardware can be any suitable mounting hardware known in the art. The cylinder is rotationally connected to the ball bearing members. In one embodiment, the cylinder is constructed from a material having high structural strength, such as steel. In a preferred embodiment, the cylinder includes a surface material cover consisting of rubber, wherein the surface material cover is designed to limit rust in embodiments where the cylinder is constructed from steel. Also, the surface material cover is configured to limit the tendency for the snow to stick to the cylinder. In a preferred embodiment, the cylinder is approximately 6 inches in diameter and 80 inches in length, weighing approximately 150 pounds. Although, the size and weight of the cylinder may be adjusted, it is critical that the cylinder is of a sufficient size and weight to compress snow 38 during operation. The operation will be discussed in greater detail below.

In one embodiment, at least one hydraulic piston 18 is provided. The at least one hydraulic piston adjusts the snow roller accessory height in relation to ground level. In one embodiment, the at least one hydraulic piston draws its power from the existing hydraulic system on the mechanical vehicle, for instance a wheel loader or backhoe (as shown in FIG. 1A). In a preferred embodiment, two hydraulic pistons are provided. The hydraulic piston will be discussed in further detail below.

In one embodiment, an interface member 22 connects the snow roller accessory to the snow blower device. On a typical mechanical vehicle, a three point hitch 17 is provided, wherein the three point hitch is connected to the interface member. It is a particular advantage of the present invention, that the snow roller accessory is designed to be compatible with typical mechanical vehicles, including having an interface member 22 configured to cooperate with the three point hitch.

In one embodiment, the snow roller accessory further comprises a pair of brackets 24 configured to connect to the interface member via mechanically fastening 32, such as mounting hardware. In an alternate embodiment, the pair of brackets may be welded to the interface member.

In one embodiment, the at least one hydraulic piston includes a first end and a second end. The first end is connected to a bracket of the pair of brackets, while the second end is connected to the support frame by way of connector extension 15 extending integrally from hinge brackets 26, wherein the hinge brackets extend upwardly from the support frame. The hinge brackets are rotationally attached to parts of the three point hitch in such a way that the protraction or retraction of the at least one hydraulic piston lifts the cylinder so as to adjust its height in relation to ground level.

During operation, the mechanical vehicle travels in a backwards direction 34 to move the snow blowing device forward and blow snow away, as well known in the art. The height of the snow blowing device relative to the ground is adjusted to provide a desired snow cover. Next, the cylinder is raised, and after each pass of snow blowing device as previously mentioned, the cylinder is lowered and the mechanical vehicle moves in a forward direction 36, enabling the cylinder to compress the snow. This process is repeated until the desired results are achieved, and the area is cleared of excess snow, leaving the area with a relatively flat surface of compacted snow. An exemplary instance of this operation is clearing the snow from a driveway. However, it should be understood, that other areas, roadways, and locations may be utilized with the present invention.

Although the invention has been described in considerable detail in language specific to structural features and or method acts, it is to be understood that the invention defined in the appended claims is not necessarily limited to the specific features or acts described. Rather, the specific features and acts are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

What is claimed is:

1. A snow removal device comprising:

a mechanical vehicle;

a snow blower connected to the mechanical vehicle via a three point hitch, and a snow roller accessory connected to the snow blower via an interface member;

wherein the snow roller accessory comprises a support frame and a cylinder, a first bracket coupled to a first end of the support frame and a second bracket coupled to a second end of the support frame;

a first ball bearing member attached to the first bracket and a second ball bearing member attached to the second bracket;

wherein the cylinder is rotationally connected to the first and second ball bearing members;

wherein the cylinder includes a surface material cover consisting of rubber, at least one hydraulic piston is provided to adjust the snow roller accessory height in relation to ground level;

the at least one hydraulic piston is operatively connected to a hydraulic system of the mechanical vehicle;

a hydraulic piston support bracket is connected to the interface member via mechanical fastening;

the at least one hydraulic piston includes a first hydraulic piston having a first end and a second end;

wherein the first end of the first hydraulic piston is connected to the hydraulic piston support bracket and the second end of the first hydraulic piston is connected to the support frame by way of a connector extension extending from a hinge bracket, wherein the hinge bracket extends upwardly from the support frame;

wherein the hinge bracket is rotationally attached relative to the three point hitch such that extension or retraction of the at least one hydraulic piston lifts or lowers the cylinder relative to the interface member.

2. The combination of claim 1 wherein a height of the snow blower relative to the ground can be adjusted by lifting or lowering of the cylinder relative to the interface member.

* * * * *